US009316371B2

(12) United States Patent
Kim

(10) Patent No.: US 9,316,371 B2
(45) Date of Patent: Apr. 19, 2016

(54) MONOTRACK-MOVABLE LIGHTING SYSTEM HAVING A LIFTING ZONE FOR MAINTENANCE

(71) Applicants: NEW TECHNOLOGY BANK CO., LTD., Daejeon (KR); Kyung Hwan Kim, Chungcheongnam-do (KR)

(72) Inventor: Kyung Hwan Kim, Chungcheongnam-do (KR)

(73) Assignees: New Technology Bank Co., Ltd., Daejeon (KR); Kwang Hwan Kim, Gongju-si, Chungcheongnam-do (KR)

( * ) Notice: Subject to any disclaimer, the term of this patent is extended or adjusted under 35 U.S.C. 154(b) by 485 days.

(21) Appl. No.: 13/920,587

(22) Filed: Jun. 18, 2013

(65) Prior Publication Data

US 2014/0369061 A1 Dec. 18, 2014

(51) Int. Cl.

| | |
|---|---|
| ***F21S 8/04*** | (2006.01) |
| ***F21S 2/00*** | (2006.01) |
| ***F21V 21/15*** | (2006.01) |
| ***F21V 21/35*** | (2006.01) |
| ***F21V 23/04*** | (2006.01) |
| *F21V 21/36* | (2006.01) |
| *F21W 131/101* | (2006.01) |
| *F21W 131/407* | (2006.01) |

(52) U.S. Cl.

CPC .... *F21S 8/04* (2013.01); *F21S 2/00* (2013.01); *F21V 21/15* (2013.01); *F21V 21/35* (2013.01); *F21V 23/0435* (2013.01); *F21V 21/36* (2013.01); *F21W 2131/101* (2013.01); *F21W 2131/407* (2013.01)

(58) Field of Classification Search

CPC ..... B66C 11/02; B66C 11/06; B66C 11/16; B66C 7/02; B61B 13/04; E01B 2203/10; F21K 9/00; F21Y 2101/02; F21Y 2103/003; F21Y 2105/001; F21S 4/00; F21S 8/038; F21S 8/04; F21V 21/34; F21V 21/36

See application file for complete search history.

(56) References Cited

U.S. PATENT DOCUMENTS

| | | | | |
|---|---|---|---|---|
| 3,673,967 | A * | 7/1972 | Kropf | B61B 5/02 104/88.05 |
| 3,718,816 | A * | 2/1973 | Seelbach | F21V 21/35 174/99 B |
| 4,025,777 | A * | 5/1977 | Hayakawa | F21S 2/005 362/249.07 |
| 6,435,698 | B1 * | 8/2002 | Schneider | B61J 1/06 362/233 |
| 6,869,209 | B2 * | 3/2005 | Layne | F21V 17/164 362/147 |
| 7,011,534 | B2 * | 3/2006 | Shen | H01R 25/142 439/116 |
| 7,063,451 | B2 * | 6/2006 | Shen | H01R 25/147 362/648 |
| 7,306,359 | B2 * | 12/2007 | Harwood | F21S 2/005 362/382 |
| 7,520,762 | B2 * | 4/2009 | Lehman | F21V 21/35 439/115 |
| 7,914,198 | B2 * | 3/2011 | Mier-Langner | F21S 8/038 361/674 |

* cited by examiner

*Primary Examiner* — Hargobind S Sawhney

(74) *Attorney, Agent, or Firm* — Rabin & Berdo, P.C.

(57) ABSTRACT

The present invention relates to a movable lighting system with lighting devices driven along a monotrack, more specifically, relates to a movable lighting system having a lifting zone where a portion of the monotrack can be moved up and down for maintenance, wherein the movable portion of the monotrack comprises a locking module.

In the monotrack-based movable lighting system of the present invention, a lifting track, moving up and down, is installed in a portion of the track; as a result, it is easy to repair and maintain the lighting devices and it is possible to accomplish safe maintenance with the help of the locking modules preventing the moving carrier from derailing when the lifting track moves up and down.

7 Claims, 11 Drawing Sheets

MONOTRACK-MOVABLE LIGHTING SYSTEM HAVING A LIFTING ZONE FOR MAINTENANCE

BACKGROUND OF THE INVENTION

1. Field of the Invention

The present invention relates to a movable lighting system with lighting devices driven along a monotrack, more specifically, relates to a movable lighting system having a lifting zone where a portion of the monotrack can be moved up and down for maintenance, wherein the movable portion of the monotrack comprises a locking module.

2. Description of Related Art

Many lighting devices are commonly used in various places and buildings, such as gymnasiums, auditoriums, performance halls, stadiums, indoor swimming pools, tunnels, subway stations, large discount stores and factories, and one of the similarities in those cases is that their ceilings are very high. It is well-known that if a lighting device is installed high on the ceiling like in the above-mentioned buildings, there are many difficulties in maintenance and much cost and huge man power are needed in piping work and wiring for installation of additional lighting devices and in changing the installation spots.

Therefore, instead of the traditional stationary lighting devices fixed high in the ceiling, a monotrack-based movable lighting system, where a light is installed in a moving carrier moving along a monotrack in the ceiling composed of trolley bars and guide rails, needs to be newly devised for easy maintenance and liable modification.

3. Technical Problem

The present invention has been made in view of the above problems, and it is an object of the present invention to provide a monotrack-based movable lighting system enabling a maintenance mechanic to do management at a pre-designated maintenance area, and enabling him/her to move the light easily to a needed area and illuminate the area with minimum lighting sources; as a result, energy saving is accomplished in an easy way.

SUMMARY OF THE INVENTION

To overcome the above discussed problems, the present invention, as the first embodiment, provides a monotrack-based movable lighting system, comprising a track fixed at a building structure; a plurality of moving carriers installed so as to move along said track; a plurality of lighting devices, each lighting device fixed at one of said moving carriers to travel together; and a lifting device to move at least a portion of said track up and down.

The second embodiment of the present invention is directed to providing a monotrack-based movable lighting system, comprising a moving carrier moving along a track; a lighting device fixed at said moving carrier to travel together; a lifting device to move a lifting track of track's lifting section up and down; and a locking module installed in said lifting track, the locking module limiting the movement of the moving carrier.

In the preferred embodiments of the present invention, the locking modules are installed at both ends of the lifting track, the locking module using the principle of the lever that if one pin is pushed, the other pin is moved so as to unlock the movement. Said locking module comprises a swing lever bracket swinging like a seesaw around a pivot axis; a locking pin bolt limiting the movement of the moving carrier, the locking pin bolt mounted at an end of said swing lever bracket; a touch pin bolt moving up and down according to the contact with a touch bracket, the touch pin bolt mounted at the opposite end of the swing lever bracket.

In the preferred embodiments of the present invention, the swing lever bracket comprises long slots at both ends where the locking pin bolt and the touch pin bolt are installed, so that a portion of the locking pin bolt and a portion of the touch pin bolt are allowed to move along the slots.

The pivot axis of the preferred embodiments of the present invention is formed closer to the touch pin bolt so that the movement of the locking pin bolt is relatively longer than that of the touch pin bolt.

In the preferred embodiments of the present invention, a spring is comprised around a lower portion of the touch pin bolt which is installed in the swing lever bracket, the spring shrinking and expanding along with the movement of the touch pin bolt.

DETAILED DESCRIPTION OF THE PREFERRED EMBODIMENTS

Hereinafter, a monotrack-based movable lighting system in accordance with a preferred embodiment of the present invention will be described in detail with reference to the annexed drawings.

First Embodiment

Figure 1:
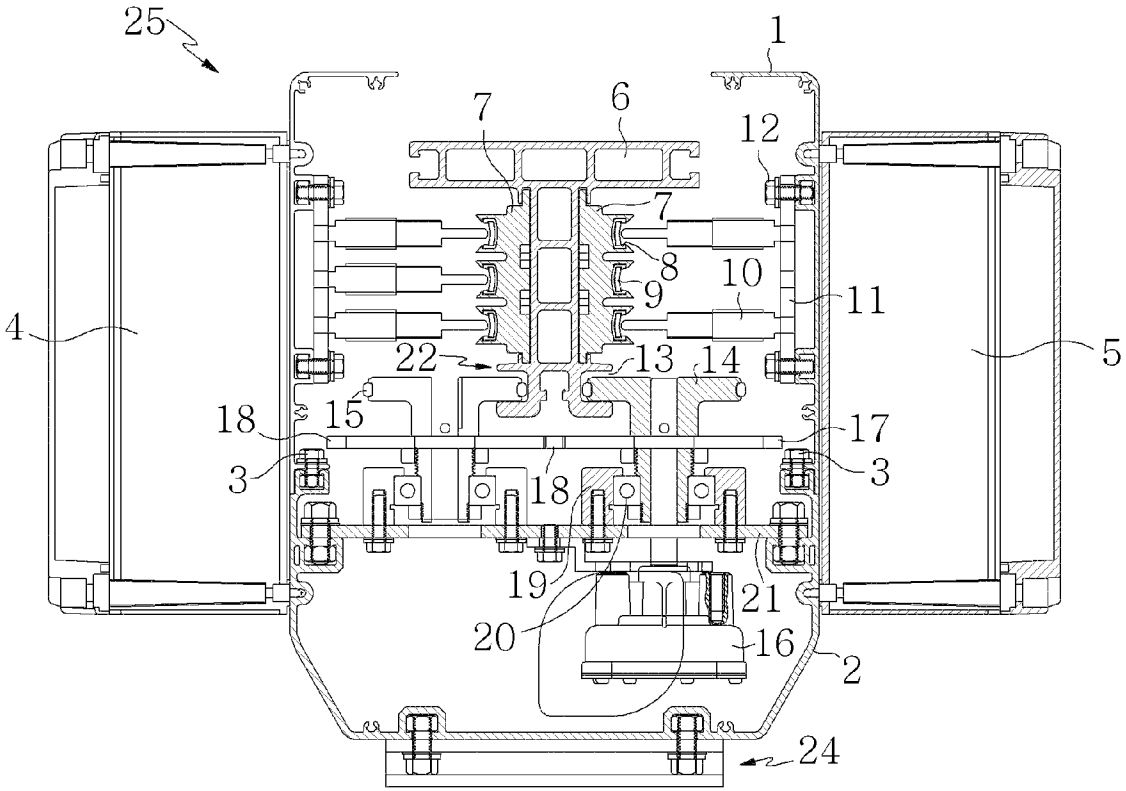
FIG. 1 is a cross-sectional view of the track and the moving carrier of a monotrack-based movable lighting system according to the present invention.

FIG. 1 is a cross-sectional view of a monotrack-based movable lighting system according to the present invention. The monotrack-based movable lighting system comprises a track fixed in the ceiling of the building structure; a moving carrier installed so as to move along said track using an electric motor; a lighting device fixed at said moving carrier to travel together.

As can be seen in FIG. 1, an inner frame 2 is attached under two side frames 1 with bolts 3, and a power supply box 4 and a control box 5 are installed at the left and right sides of the moving carrier 25, respectively.

A track 6 is disposed in the center of the side frames 1, and trolley bar grips 7 are attached on both lower sides of the track 6 in a symmetric manner. A plurality of grooves are formed on the left and right sides of the trolley bar grips 7, wherein insulation covers 8 and trolley bars 9 are inserted into the grooves. A plurality of brush holders 10 are disposed horizontally adjacent to said trolley bars 9, and the brush holders 10 are connected to a brush supporter 11 which is fixed to one of the side frames 1 with holders 12.

Rails 22 are formed at both sides of the lower portion of the track 6, the rails 22 comprising driving slots 13 into which wheels 14 are inserted. A tension ring 15, which is made from rubber, is formed around each wheel 14 so as to reduce slip, and a wheel gear 17 is integrated in the middle of the body of each wheel 14.

The wheel gear 17 is driven to rotate by an electric motor 16, and said wheel gear 17 rotates another adjacent wheel gear 17 interlocking via gear teeth 18.

The wheel 14 is attached to the shaft of the electric motor 16 through its center and rotates together with the electric motor 16; moreover, a bearing 20 and a bearing housing 19 are inserted into the middle of the body portion of the wheel 14 so as to support and help the wheel 14 smoothly rotate. The bearing housing 19 is combined with a bearing housing support 21, whose ends are attached to the inner frame 2.

The wheel gear 17 is formed and integrated in the body of the wheel 14 so that it rotates together with the wheel 14; as a result, the adjacent wheel 14 on the opposite side rotates with the help of rotation of its own wheel gear 17, which interlocks via gear teeth 18.

There are two driving assemblies composed of the wheels 14 and the electric motor 16 in the front and the back of the moving carrier 25 in the same manner. In other words, another combination of two wheel gears 17 interlocking together and its driving electric motor 16 is disposed in the back of the moving carrier 25, which means the moving carrier 25 works like 4-wheel drive in the vehicle. The present driving mechanism prevents the wheels 14, which is moving along the driving slot 13, from skidding; in addition, it guarantees an accurate driving even in the curved rails 22 as well as in the linear rails 22.

Figure 2:
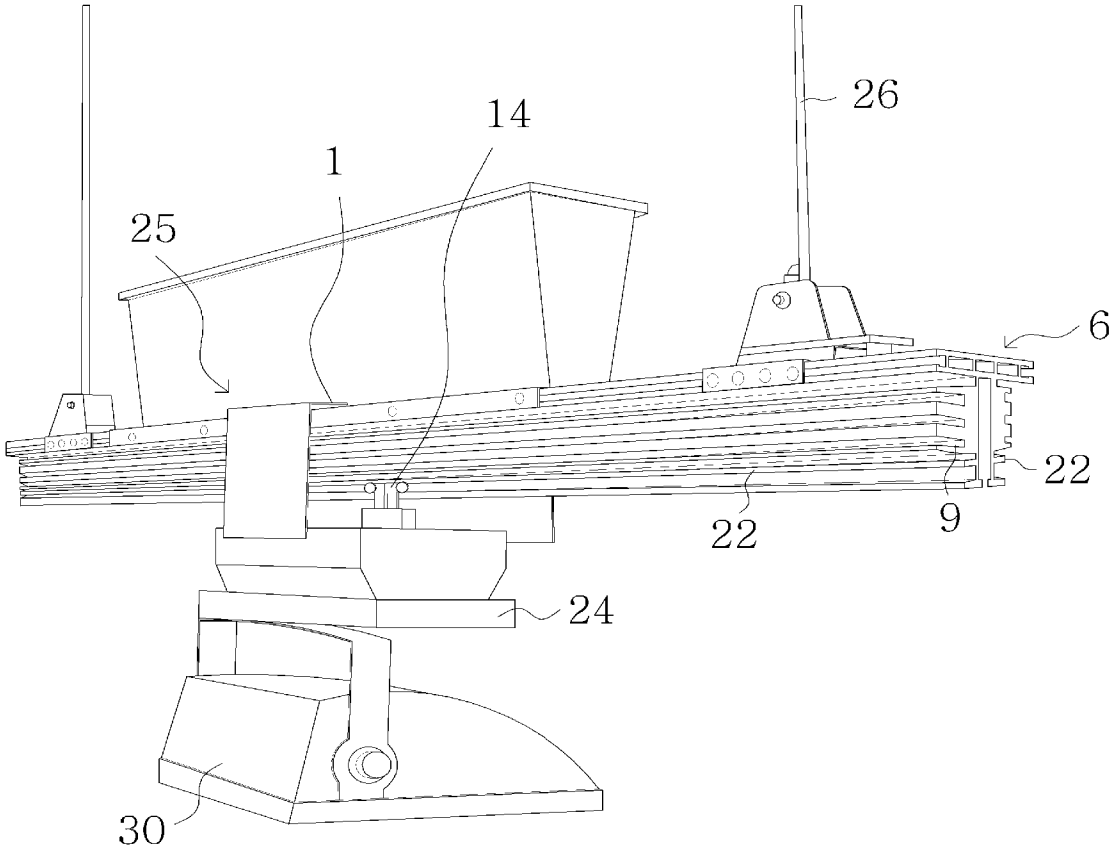
FIG. 2 is a perspective picture of a monotrack-based movable lighting system with a lighting device attached on a moving carrier.

FIG. 2 is a perspective picture of an assembling structure of the present invention, showing that a lighting device 30 is attached to the moving carrier 25, which is disposed on the track 6. The track 6 is fixed using holding means 26 to the building structure, such as the ceilings.

A holding member 24 is selectively installed at the bottom of the moving carrier 25 so as to hang the lighting device 30. The holding member 24 can be in various shapes according to the purpose, and it can be formed at any position of the moving carrier 25 including both sides and bottom portion.

All kinds of lighting devices commonly used in every area can be said lighting device 30, more desirably, LED lighting devices are appropriate.

Figure 3:
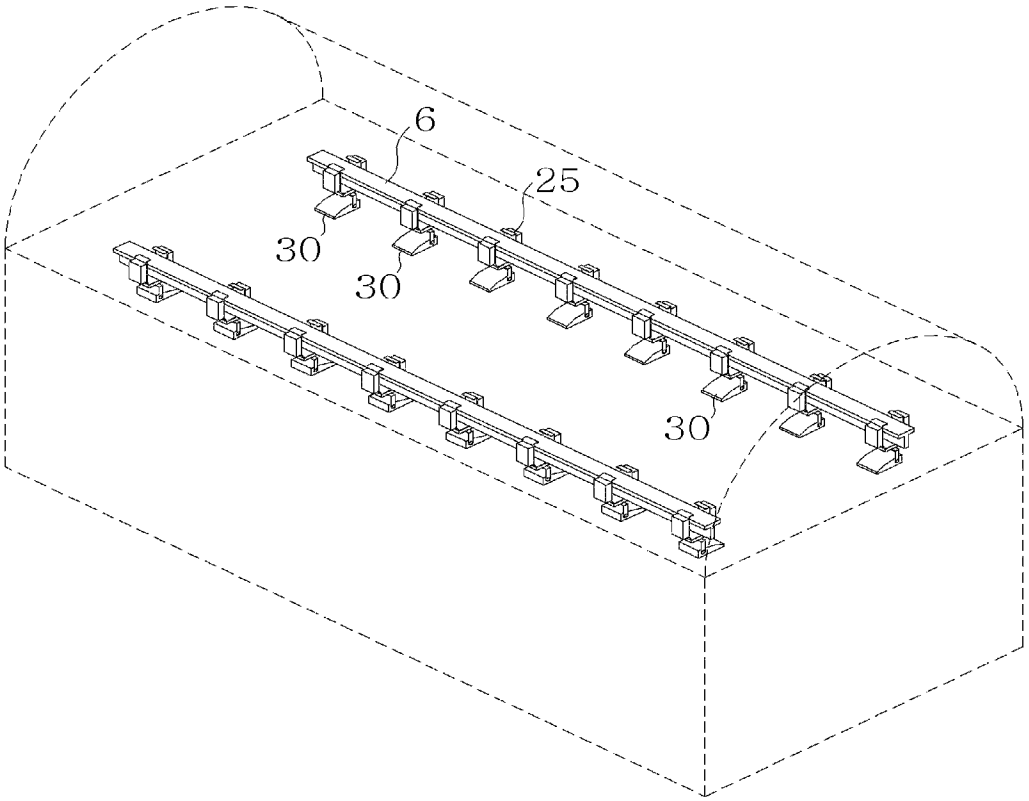
FIG. 3 is a perspective view of an installation example of a linear track.
Figure 4:
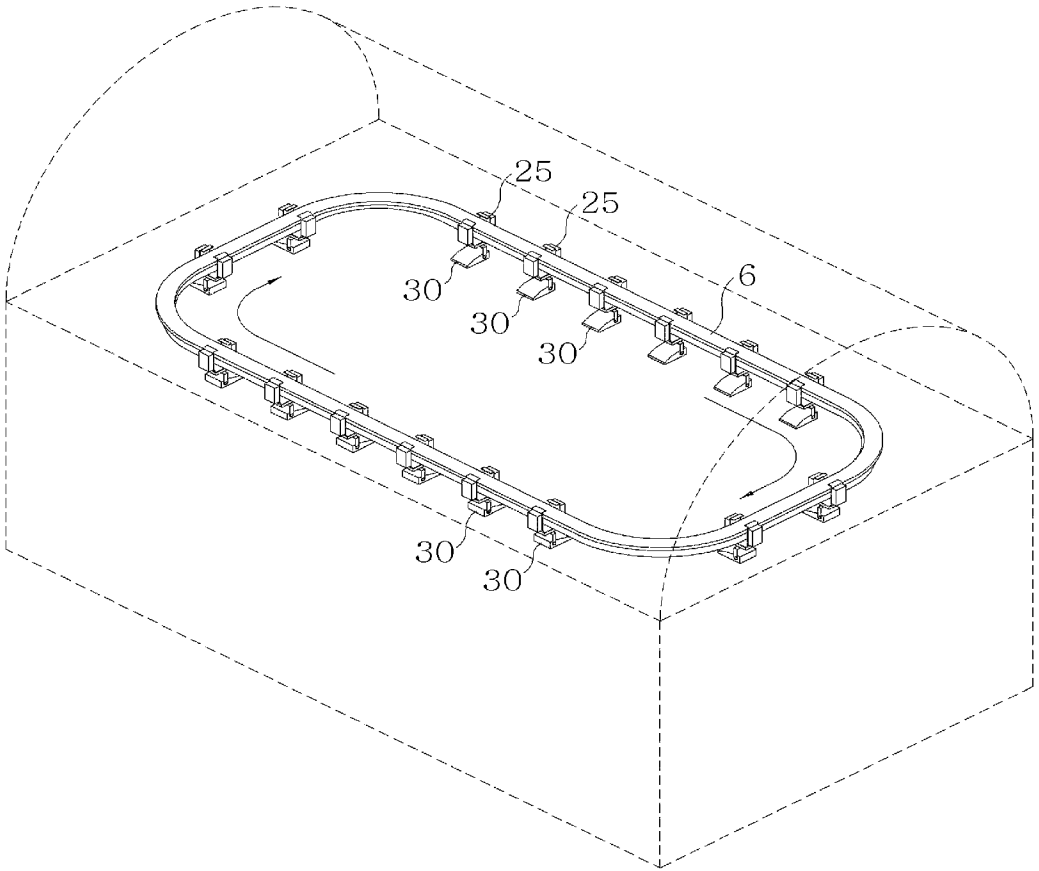
FIG. 4 is a perspective view of an installation example of an elliptical track.
Figure 5:
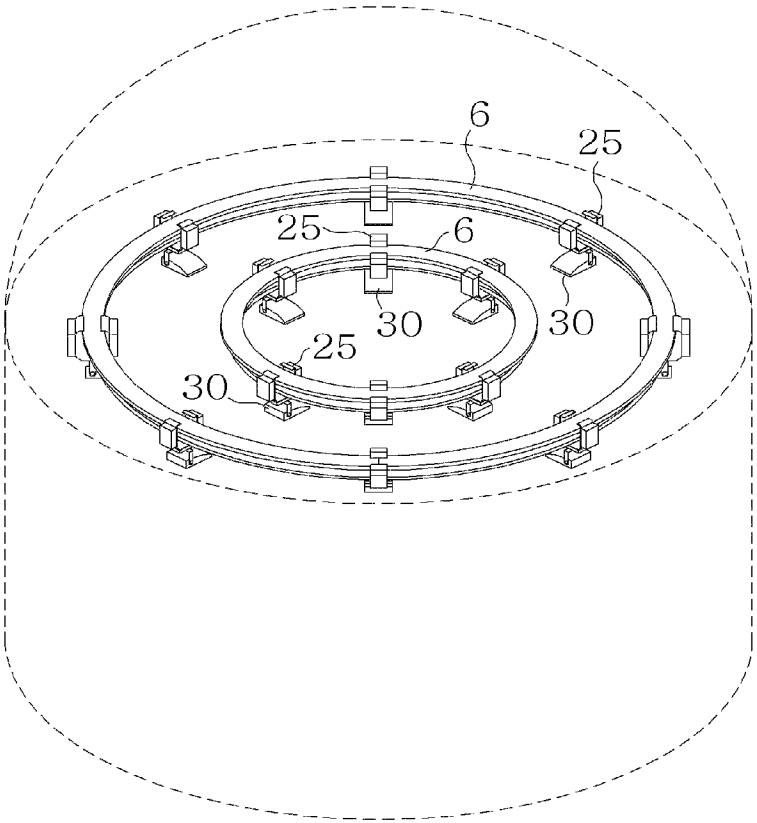
FIG. 5 is a perspective view of an installation example of a circular track.

FIGS. 3, 4 and 5 denote various installation examples of the track 6. The track 6 can be in various shapes, such as linear, elliptical, or circular shapes, according to the indoor arrangement of the building structure.

Said monotrack-based movable lighting system is controlled using a radio wire communication, more preferably, it operates using a radio communication. It is preferable that eight trolley bars 9 should be installed in the trolley bar grips 7. Four of them are used as power lines supplying electric power to the electric motors 16 and the lighting device 30 of the moving carrier 25. Two of said nine trolley bars 9 can be used as data communication lines, making communication possible between the main controller and the sub-controller of the controlling device. The rest of the trolley bars 9 function as D.C. supply lines supplying D.C. power to the sub-controller.

Said moving carrier 25 freely moves to the specified position in response to the control signals delivered from the main controller to the sub-controller through the trolley bars 9 designated as the data communication lines. That is, if a control signal of moving is transferred from the main controller through the trolley bars 9, said sub-controller makes the electric motor 16 of the moving carrier 25 operate so as to make the moving carrier 25 travel along the track 6. In this case, the moving distance of the moving carrier 25 is measured by distance measuring means, such as encoders, wherein the measured distance is transferred to the main controller through the trolley bars 9 designated as the data communication lines so that the main controller can make sure if the moving carrier 25 moves the specified distance.

In addition to the control signals of the movement of the moving carriers 25, various control signals, such as on-off signals of the lighting device 30 and angle control signals of the light, are also transferred from the main controller to the sub-controller through the trolley bars 9; at the same time, the main controller can confirm whether the given control signals are fulfilled. It is more preferable that the moving carriers 25 on the track 6 can be individually controlled by said control devices.

Second Embodiment

The second embodiment of the present invention moves either the track 6 or a portion of the track 6 up and down for maintenance and cleaning of the monotrack-based movable lighting system.

Figure 6:
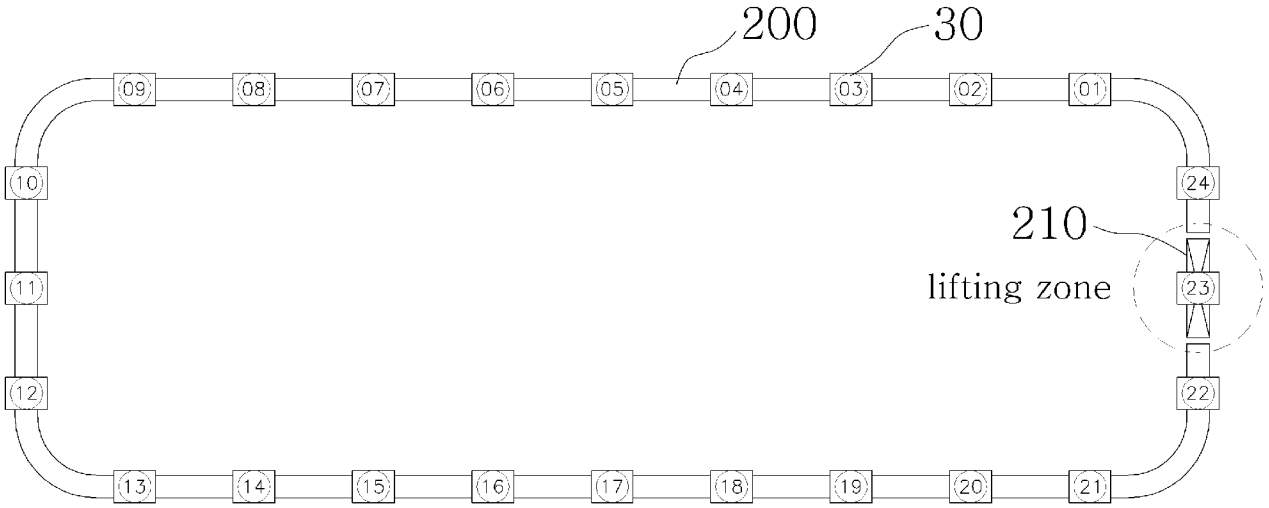
FIG. 6 is a top view of an installation example of an elliptical track with a lifting zone for maintenance.
Figure 7:
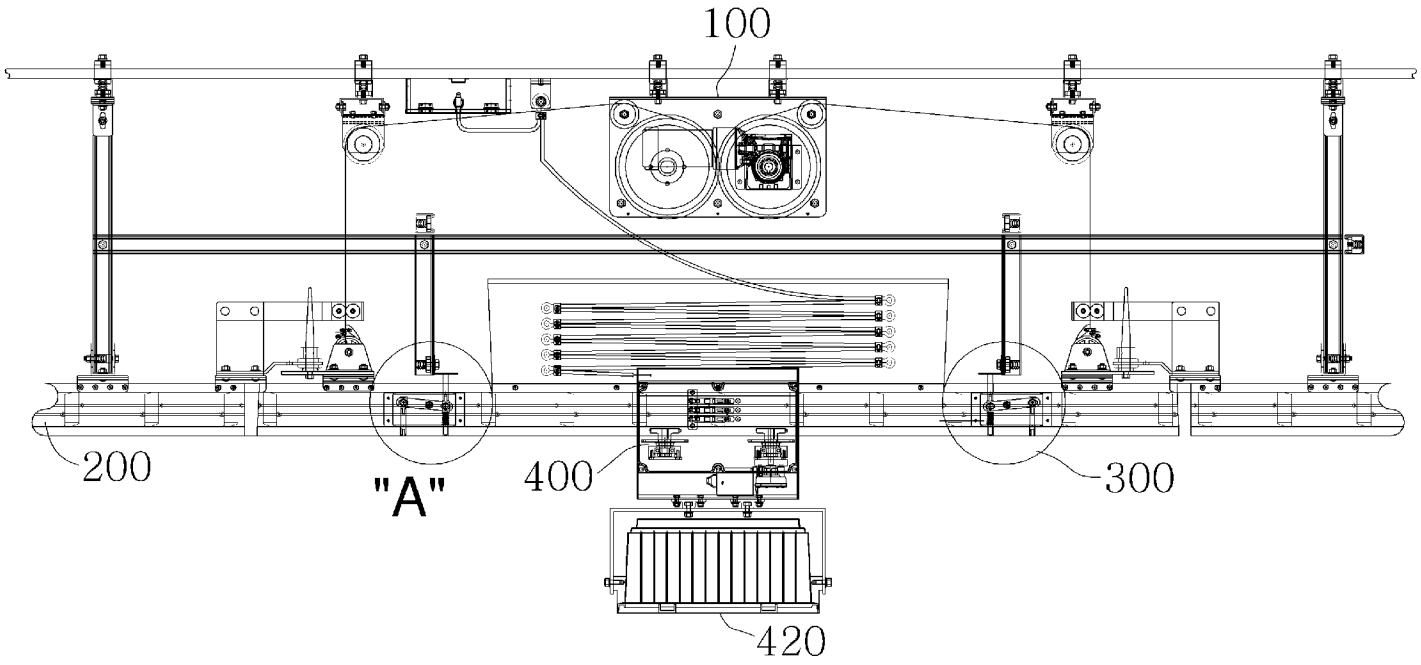
FIG. 7 is a side view of the lifting track of a monotrack-based movable lighting system according to the present invention, showing that the lifting track is in the upper position.
Figure 8:
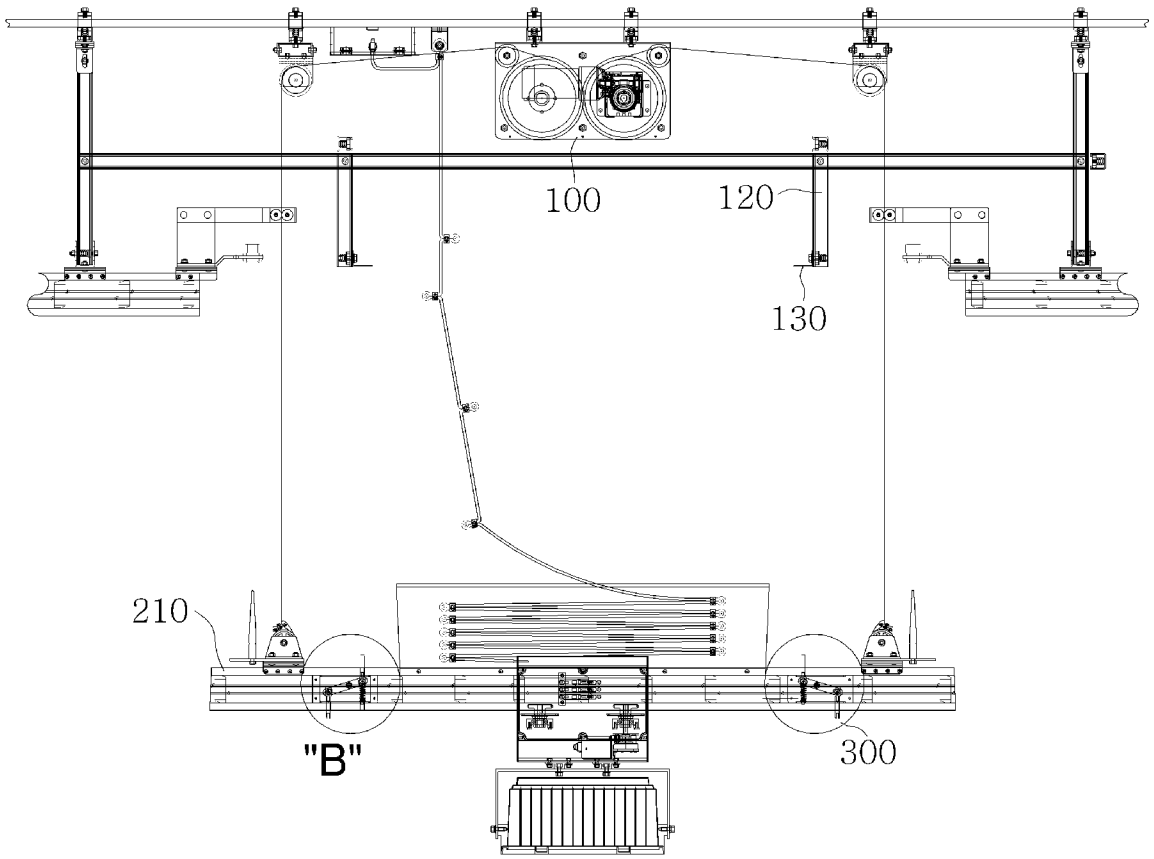
FIG. 8 is a side view of the lifting track of a monotrack-based movable lighting system according to the present invention, showing that the lifting track is in the lower position.

FIG. 6 shows a top view of a lifting zone in an elliptical track, wherein a portion of the track 6 can be moved up and down. FIG. 7 shows a state that the lifting track 210 is in the upper position to be combined with the main track 6. FIG. 8 shows a state that the lifting track 210, where a lighting device 30 is loaded for maintenance, is lowered to the lower position in the lifting zone.

A monotrack-based movable lighting system according to the present invention comprises a moving carrier 400 moving left and right along a track 200; a lighting device 420 fixed at the moving carrier 400 to travel together; and a lifting track 210 disposed in the lifting zone of the track 200 and moving up and down by a lifting device 100.

The lifting device 100 comprises a driving gear 101 driven to rotate by an electric motor; a driven gear 102 interlocking and rotating together with the driving gear 101; and lifting wires 103, 104 rolling up the lifting track 210, the lifting wires wound or unwound around the driving gear 101 and the driven gear 102 according to the rotation of said gears 101, 102.

As the driving gear 101 and the driven gear 102 interlock together and they are in the same size, the wound and unwound lengths of the wire 103 of the driving gear 101 and the wire 104 of the driven gear 102 are the same; therefore, the lifting track 210 rolled up can remain horizontal.

The lifting track 210 gains electric power and maintains data communication through the trolley bars and a cable 105 which can be folded and unfolded in a zigzag manner inside a cable box 106 during the maintenance.

Third Embodiment

A monotrack-based movable lighting system according to the present invention further comprises a plurality of locking modules 300 in the lifting track 210 so that the locking modules 300 mounted at both ends of the lifting track 210 prevent the moving carrier 400 from derailing during the elevation of the lifting track 210.

Figure 9:
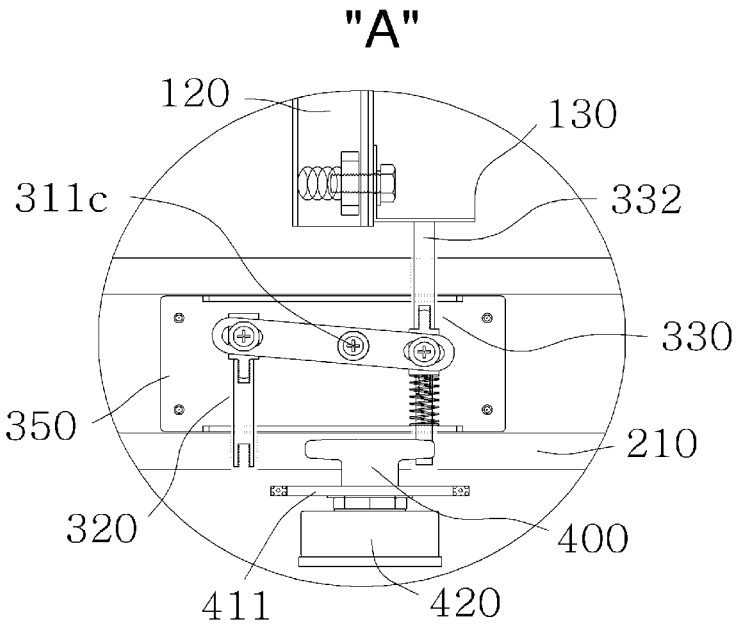
FIG. 9 is an expanded side view of the locking module of a monotrack-based movable lighting system according to the present invention.
Figure 9:
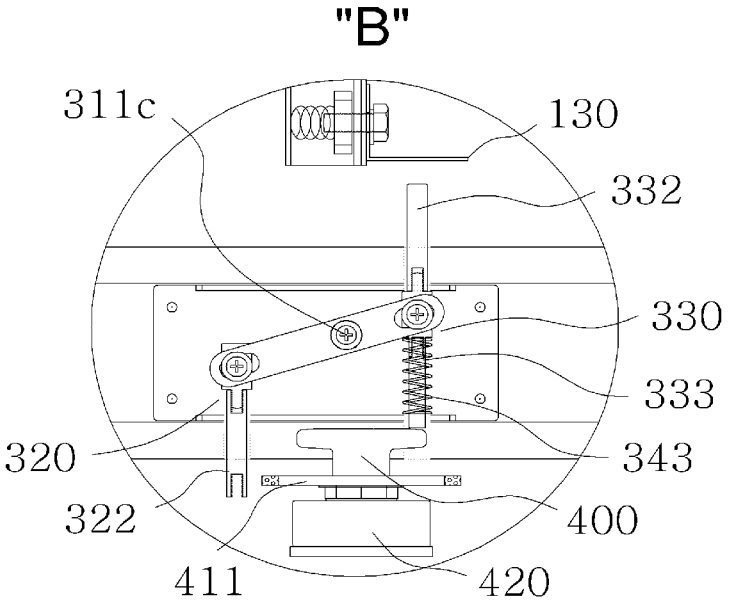

FIG. 9 is a side view of the locking module 300 during the elevation of the lifting track 210, showing expanded views of part A and B denoted in FIG. 7 and FIG. 8.

The locking modules 300 are mounted at both ends of the lifting track 210. A touch pin bolt 332 is pressed by a touch bracket 130 when the lifting track 210 is horizontally in the same level as the main track 200; therefore, a locking pin portion 320 goes up under the principle of the lever so as to unlock the locking module 300.

A locking pin bolt 322 of the locking pin portion 320 functions as a stopper to limit the movement of the moving carrier 400. The locking pin bolt 322 is released in normal operation; therefore, the moving carrier 400 can freely travel along the track 200.

As the lifting track 210 is lowered for maintenance or cleaning of the lighting device 420, the touch pin bolt 332 is released from the touch bracket 130; as a result, the touch pin portion 330 goes up by the elastic force of a spring 343 mounted around a lever spring insert bolt 333. Then, the locking pin portion 320 in the opposite goes down by the pivot axis 311*c* under the principle of the lever. Even when the moving carrier 400 loses its balance and moves back and forth due to the movement of the lifting track 210, the wheel gear 411 of the moving carrier 400 touches the locking pin bolt 322 and prevents the movement of the moving carrier 400.

Figure 10:
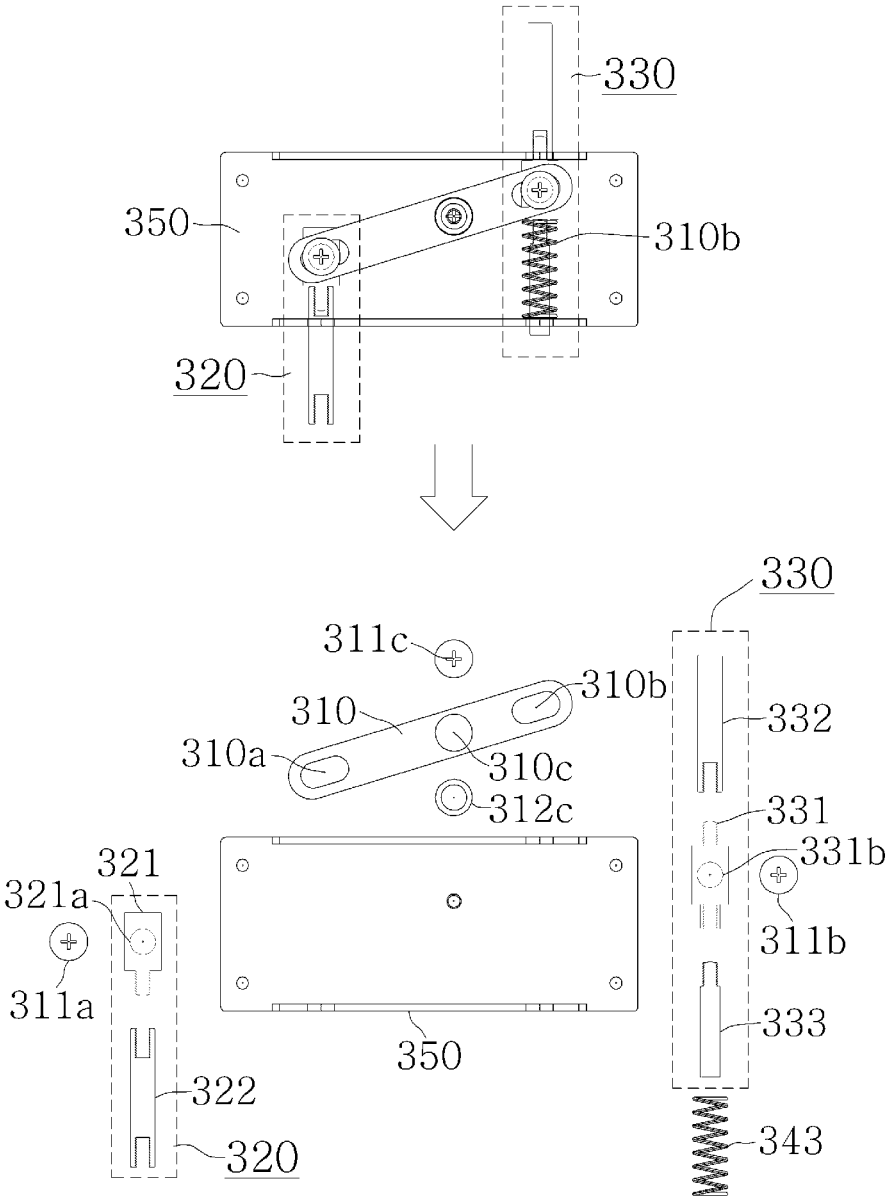
FIG. 10 is an exploded view of the locking module of a monotrack-based movable lighting system according to the present invention.

FIG. 10 is an exploded view of the locking module 300. The locking pin portion 320 comprises a locking pin lever socket 321 and a locking pin bolt 322, whereas the touch pin portion 330 comprises a touch lever socket 331, a touch pin bolt 332, and a lever spring insert bolt 333. The spring 343 is inserted around said lever spring insert bolt 333.

The pivot axis 311*c* is inserted into a supporting hole 310*c* of the swing lever bracket 310 so as to be fixed to the frame 350 using a nut 312*c*, so the pivot axis 311*c* supports the swing lever bracket 310. The locking pin lever socket 321 and the touch lever socket 331 are installed using bolts 311*a*, 311*b* into the supporting holes 310*a*, 310*b* formed at both ends of the swing lever bracket 310.

The supporting holes 310*a*, 310*b*, into which the supporting bolts 311*a*, 311*b* are inserted, are in the shape of long openings permitting the supporting bolts 311*a*, 311*b* to move inside the supporting holes 310*a*, 310*b*, which helps the locking pin portion 320 and touch pin portion 330 remain perpendicular to the track 210 as the swing lever bracket 310 rotates around the pivot axis 311*c*.

As the locking pin portion 320 and the touch pin portion 330 move in the opposite directions, one of them goes down to the lower portion of the frame 350. Whether the moving carrier 400 can go through the point where the locking module 300 is disposed or not depends on how far the locking pin bolt 322 and the lever spring insert bolt 333 move down. Therefore, the pivot axis 311*c* and the supporting hole 310*c* of the swing lever bracket 310 need to be formed closer to the touch lever socket 331 than the locking pin lever socket 321, so that the locking pin portion 320 can move longer distance than the touch pin portion 330.

For instance, after the ratio of the distance from the locking pin lever socket 321 to the pivot axis 311*c* and the distance from the touch lever socket 331 to the pivot axis 311*c* is set to be 6:4, if the touch pin bolt 332 is pressed by the touch bracket 130 due to the elevation of the lifting track 210 like in FIG. 9A, the lever spring insert bolt 333 goes down and the locking pin bolt 322 goes up.

As the touch pin bolt 332 is released from the touch bracket 130 due to the lifting track 210 moving down like in FIG. 9B, the touch pin portion 330 goes up and, at the same time, the locking pin portion 320 goes down with the elastic force of the spring 343. Because the pivot axis 311*c* is closer to the touch lever socket 331, the touch pin portion 330, which will relatively move shorter distance than the locking pin portion 320, doesn't limit the movement of the moving carrier 400 even with maximum travel distance. On the other hand, the locking pin portion 320, which will relatively move longer distance than the touch pin portion 330, moves down to the bottom of the lifting track 210 at the maximum travel distance, so that the movement of the moving carrier 400 can be limited using the wheel gear 411 touching the locking pin portion 320.

Figure 11:
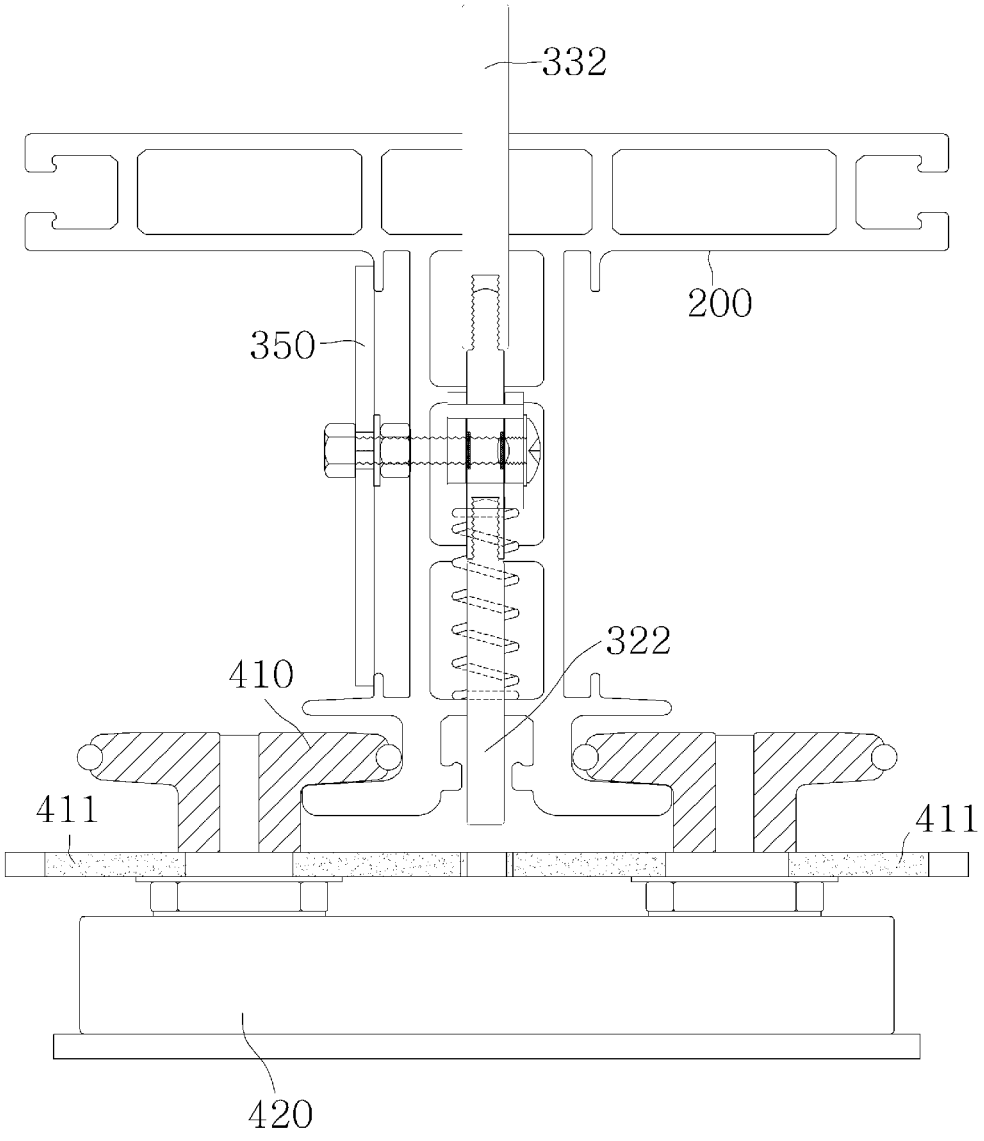
FIG. 11 is a cross-sectional view of the moving carrier of the present invention traveling along the monotrack.

FIG. 11 is a cross-sectional view of the moving carrier 400 traveling along the monotrack. The moving carrier 400 moves using two wheels 410 rolling down both sides of the track 200, wherein the wheels 410 are driven by the electric motor using gear mechanism. As can be seen in FIG. 11, in the locking modules 300 mounted inside the track 200, as the locking pin bolt 322 and the lever spring insert bolt 333 stick out of the track 200 due to the rotation of the swing lever bracket 310, the locking pin portion 320 moves down farther than the bottom of the track 200 and the locking pin bolt 322 touches the wheel gear 411 so as to limit the movement of the moving carrier 400.

What is claimed is:

1. A monotrack-based movable lighting system, comprising a track having rails on the left and right sides of its body;

a plurality of wheels respectively installed in the rails;

a plurality of wheel gears formed in the wheels and interlocking together with each other; and a plurality of electric motors coaxially combined with the wheels, wherein the electric motors drive the wheel gears so that the wheels can move along the rails.

2. The monotrack-based movable lighting system of claim 1, wherein a rubber tension ring is formed around each wheel so as to reduce slip when moving along the rails.

3. The monotrack-based movable lighting system of claim 1, wherein the combination of the wheels having the wheel gear is installed to each front and back portion of the lighting system, and wherein each combination is driven by its electric motor.

4. The monotrack-based movable lighting system of claim 1, wherein the lighting system further comprises a plurality of moving carriers disposed so as to move along the track; a plurality of lighting devices mounted on each moving carrier so as to move together; and a lifting device moving at least a portion of the track up and down.

5. The monotrack-based movable lighting system of claim 4, wherein the lifting device comprises a driving gear rotated by an electric motor; a driven gear interlocking and rotating together with the driving gear; and lifting wires rolling up at least a portion of the track, the lifting wires wound or unwound by the rotation of the driving gear and the driven gear.

6. The monotrack-based movable lighting system of claim 4, wherein the lighting system further comprises a lifting track moving up and down in a lifting zone; and locking modules installed at both ends of the lifting track so as to prevent the moving carrier from derailing.

7. The monotrack-based movable lighting system of claim 6, wherein the locking modules use the principle of the lever, and wherein if one pin is pressed, the other pin moves so as to release the locking.

* * * * *